US005080253A

United States Patent [19]

Zieke

[11] Patent Number: 5,080,253

[45] Date of Patent: Jan. 14, 1992

[54] RECLOSABLE BOX LINER

[75] Inventor: Larry M. Zieke, Midland, Mich.

[73] Assignee: The Dow Chemical Company, Midland, Mich.

[21] Appl. No.: 869,526

[22] Filed: Jun. 2, 1986

[51] Int. Cl.[5] ..... B65D 30/10; B65D 33/24; B65D 5/44

[52] U.S. Cl. ..... 220/403; 220/463; 220/470; 383/63; 383/122; 53/396; 53/473

[58] Field of Search ..... 220/403, 404, 410, 460, 220/461, 462, 463; 383/63, 94, 104, 122; 53/396, 473

[56] References Cited

U.S. PATENT DOCUMENTS

| | | | |
|---|---|---|---|
| 3,326,449 | 6/1967 | Dickson | 383/94 |
| 3,357,152 | 12/1967 | Geigel . | |
| 3,375,969 | 4/1968 | Davis, Jr. . | |
| 4,524,459 | 6/1985 | Titchenal . | |
| 4,561,107 | 12/1985 | Herder . | |

FOREIGN PATENT DOCUMENTS

| | | | |
|---|---|---|---|
| 280826 | 10/1966 | Australia | 220/460 |
| 738267 | 7/1966 | Canada | 383/94 |
| 1137074 | 5/1957 | France | 220/460 |
| 588982 | 2/1959 | Italy | 220/460 |
| 974838 | 11/1964 | United Kingdom | 383/94 |

*Primary Examiner*—Stephen Marcus

[57] ABSTRACT

A reclosable plastic box liner having a reclosable fastener of a length relatively the same as that of the width of the box when the liner is filled with products such as cereals, crackers or chips. To achieve a liner having sufficient size to fill the box, yet, having a reclosable fastener of a correct length, the top section of the liner is cropped or chamfered at its ends generally above the product fill level of the liner. Preferably, the chamfered section is angled from the vertical at least from the product fill level to the reclosable fastener.

5 Claims, 2 Drawing Sheets

Fig. 1
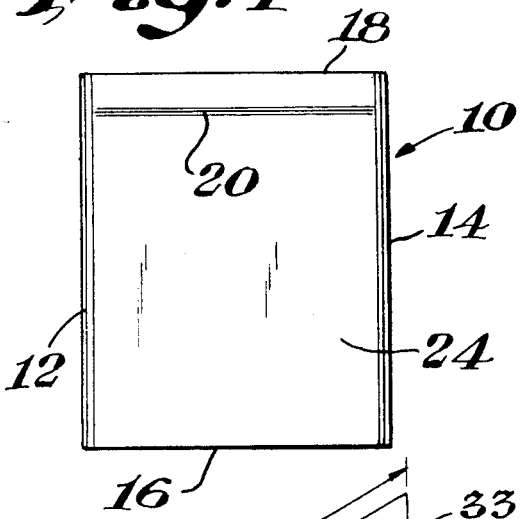
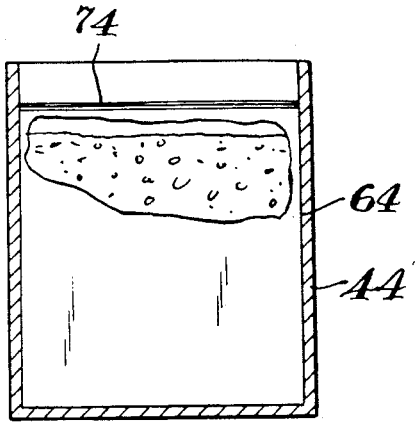
Fig. 10
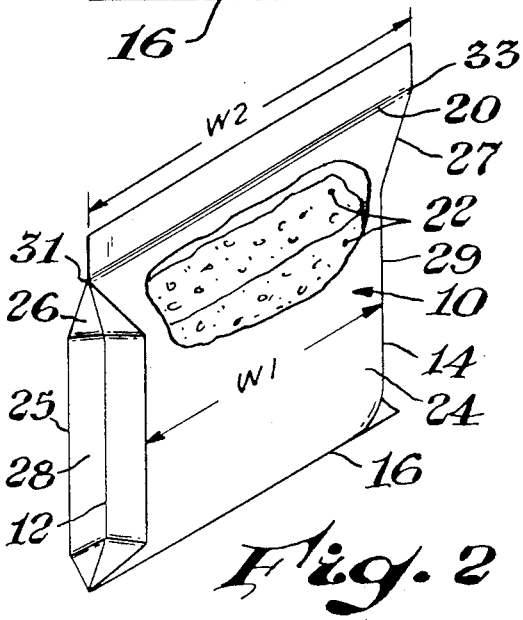
Fig. 2
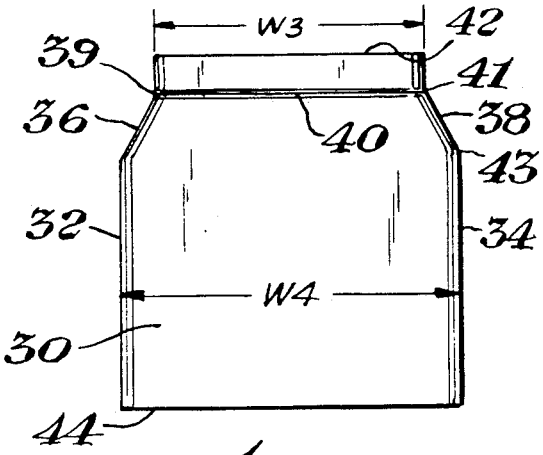
Fig. 3
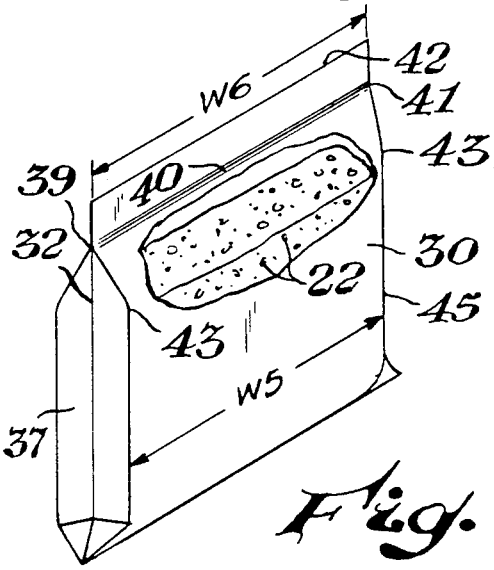
Fig. 4
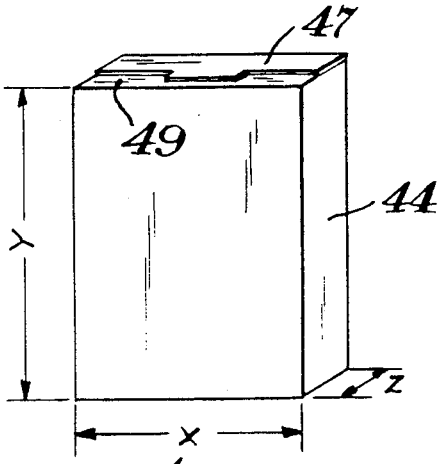
Fig. 5

RECLOSABLE BOX LINER

BACKGROUND OF THE INVENTION

There has been a long-felt need for cereal, cracker or chip box packages and the like, which are secured against contamination and moisture in the atmosphere, but yet are readily openable and reclosable so that when the package is opened and only a portion of the contents is removed, the remainder can be conveniently saved for future use. Most such packages presently comprise a box with a bag type liner which must be ruptured permanently or have flanges that are permanently separated to gain access to the contents. It is next to impossible to efficiently reseal the package. Consumers generally either roll the bag liner closed as best they can or stuff the top of the bag back into the box and close a loosely interlocking flap on the top of the box, neither of which methods fully close the package or adequately protect the contents from the surrounding environment. A reclosable fastener, such as that usable with the bag liner of this invention, can be that shown, for example, in British Patent 2,133,462, having a male fastener with ribs on either side thereof and an interlockable female fastener, similar to that presently sold by The Dow Chemical Company and identified as a ZIPLOC® Brand Bag with a wide track profile.

Taking an ordinary reclosable bag, such as that described in the before-identified British Patent, and just placing it in the box as a liner still does not provide a fully satisfactory package. When the bag or liner is filled with product, the reclosable fastener, which is relatively stiffer than the film of the bag body, ends up being wider than the box in which it is contained. This naturally occurs with a generally rectangular shaped unfilled, flat bag that is filled and made to conform to a three dimensional shape, such as a box. Since the reclosable fastener section of the liner is wider than the box, when an attempt is made to push the fastener section into the box, it must be pushed together laterally. This can result in the fastener section being accordioned or crimped and is not readily openable. To be readily opened would require that the reclosable fastener section be raised again, taken from the box from where it has been stuffed, spread lengthwise to a width wider than that of the box, and then unzipped or otherwise unfastened. It would then be reclosed before stuffing the fastener section back into the box. Beside requiring more material than is necessary to form the liner, the above procedure results in an inconvenient closure which is essentially nonfunctional when it is below the top opening of the box in which it is contained. Prior to this invention there was thus the need to have a reclosable box liner which has a reclosable fastener of about the same width as the width of the box so that it would fit comfortably therewithin, avoiding wasted material, and even being openable and reclosable within the box below the open top of the box should that be desired, or in any other position as may be desired.

SUMMARY OF THE INVENTION

This invention comprehends a reclosable bag or liner for placing in a box, as a package wherein a reclosable fastener, when the liner is filled with product, has a width which is approximately the width of the box and is readily openable and reclosable at any reachable height within or outside the box. With the length of the reclosable fastener so designed, the reclosable top section of the liner is more easily rolled back into the box and will set correctly in the box rather than sideways or in some other awkward position when the relatively stiff reclosable fastener is too wide, and will be more attractive and readily openable and reclosable at any desired reachable height within the box or out of the box. The proper width of reclosable fastener is achieved by providing cropped-like ends or ears at and adjacent the extremities of the reclosable fastener, preferably with a predetermined seal angle. Generally, the angle of the seal of the cropped ears forms a chamfered section preferably running from the product level within a filled liner to the reclosable fastener level, and a process to calculate a desirable seal angle has been discovered. By employing the concept of this invention, a liner for a box which is easily openable and readily reclosable, and convenient to be rolled back into the box, has been provided.

BRIEF DESCRIPTION OF THE DRAWINGS

FIG. 1 is a schematic elevational view of a prior art reclosable bag in the unfilled state;

FIG. 2 is an isometric view showing the bag of FIG. 1 filled with product;

FIG. 3 is a schematic elevational view of the bag or liner of the present invention in the unfilled FIG. 4 is an isometric view of the bag or liner of FIG. 3 filled with product;

FIG. 5 is an isometric view of a box in which the bag or liner of FIG. 3 is to be placed;

FIG. 10 is a schematic elevational view of the liner of the present invention when filled and located in the box of FIG. 5.

DETAILED DESCRIPTION OF THE DRAWING

Figure 6:
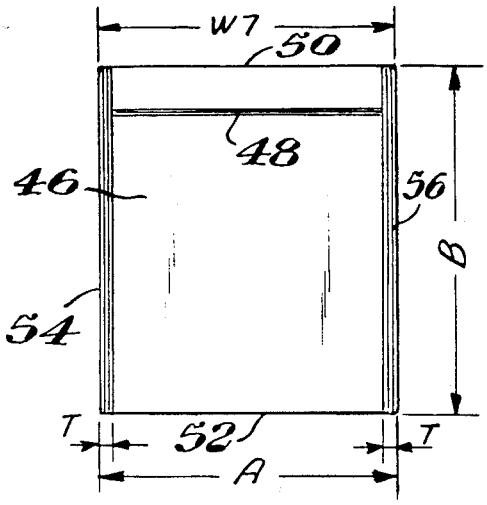
FIG. 6 is a cross-sectional elevational view of a bag such as shown in FIG. 1, with dimensional notations.

Referring more particularly to FIG. 1, there is shown a prior art bag such as that taught in British Patent 2,133,462, which bag 10 has straight side seals 12 and 14, a bottom 16, top 18, and a reclosable fastener 20.

FIG. 2 shows the bag of FIG. 1, which is empty, filled with a product 22. Product 22 causes the front and rear panels 24 and 25 to bulge outwardly causing a spreading of the ends 28 and 29 including side seals 12 and 14. However, the reclosable fastener 20 maintains essentially its same configuration when the bag is filled or empty and causes a depression thereunder as indicated by the angular disposition of the top parts 26 and 27 of the ends 28 and 29, respectively, which are essentially mirror images of each other. Thus, a width W1 of the bag 10 when filled between the side ends 28 and 29 is less than the width W2 between ends 31 and 33 of reclosable fastener 20 at the top section of the bag 10 thereabove.

Differentiating from the bag 10 of FIGS. 1 and 2, is the bag or liner 30 of the present invention shown empty in FIG. 3 and filled with product in FIG. 4. Side seals 32 and 34 of the bag of FIG. 3 are chamfered at its top section along edges 36 and 38 so that the length W3 of a reclosable fastener 40 between its ends 39 and 41 is less than the width W4 of bottom 44 of the bag when the bag or liner is empty. However, when the liner or bag 30 is full of product 22, the width of the bag W5 is the same as the width W6 of the top of the bag 42 and the length of reclosable fastener 40. Side ends 37 and 45 formed when liner or bag 30 is filled ideally are generally aligned with the ends 39 and 41, respectively, of the reclosable fastener 40 so that the seals 32 and 34 are relatively straight seals all the way to the top 42 of bag 30, or at least to the reclosable fastener 40. To achieve this, it is preferred that cropped-like ends 36 and 38 of the bag 40 are formed as angular seals extending approximately from the anticipated product level fill point 43 to the reclosable fastener ends 39 and 41. While other than a straight line between the fill point 43 and ends 39 and 41 may be possible, a straight line would appear preferable as it forms the shortest distance between the two points. This angular disposition has been found to be functionally quite satisfactory. In order to fabricate a liner or bag having a reclosable fastener which will be about the same length as the width of a box in which the bag or liner is located when filled, it was discovered that a process could be designed to determine preferred embodiments for various boxes as more adequately defined below with respect to FIGS. 4 through 9.

Figure 7:
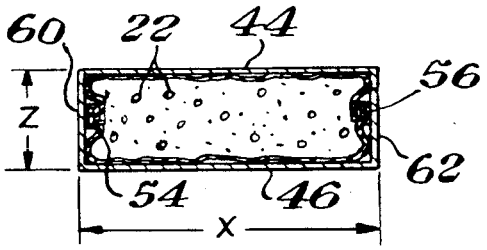
FIG. 7 is a cross-sectional plan view of the box of FIG. 5 with a bag of FIG. 6 inserted therein as a liner, with dimensional notations.
Figure 8:
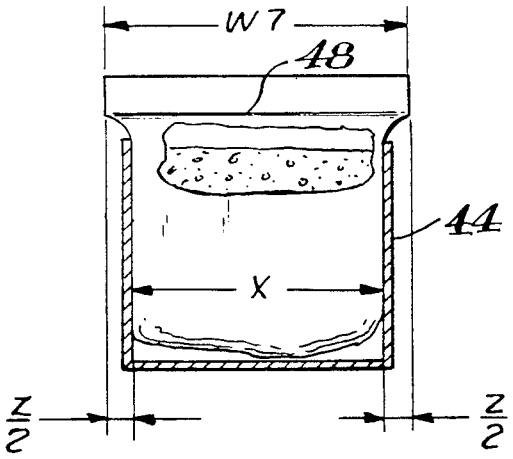
FIG. 8 is a schematic elevational view of the bag liner of FIG. 6 as it projects from the top of the box of FIG. 5 when filled and located.

Taking a box 44 such as shown in FIG. 5 in which a liner is to be inserted, which box can have a typical interlocking top with flaps 47 and 49 with a tongue and slot interlock, the box 44 could have its width defined as the dimension X, its height defined as the dimension Y and its depth defined as the dimension Z. Such a typical box could contain a liner which can comprise a reclosable bag 46 having a reclosable fastener 48, a top 50, a foldable bottom 52 and side seals 54 and 56. This liner unfilled would have a width, represented by reference character A, and a height represented by the character B. When the liner 46 is inserted into the box 44 and filled with product 22, the film of the liner takes the shape of the interior of the box, and the side seals 54 and 56 fold against the ends 60 and 62 of the box filling the cross-section of the liner 46. The box 44 essentially determines the liner height and width as a function of the box dimensions, i.e., the liner width A is equal to two times the seal width T (FIG. 6) of the liner 46 plus one-half Z plus X plus one-half Z. If the liner 46 with the dimensions A and B is then inserted into the box 44 with the dimensions X, Y and Z, the film of the liner will essentially take the shape of the box as shown in FIG. 7, and reclosable fastener 48 will be longer (length W7 in FIG. 6) than the width X of the box by the distance Z, which is equivalent to the two dimensions Z/2 or $\frac{1}{2}Z$ as shown more clearly in FIG. 8. Since the reclosable fastener 48 is longer than the width X of the box, it is awkward to fold down that portion of the bag liner containing the reclosable fastener 48 into the box, and crimping or bunching up of the top of the liner containing the reclosable fastener is necessary to stuff the top of the liner in the box.

Figure 9:
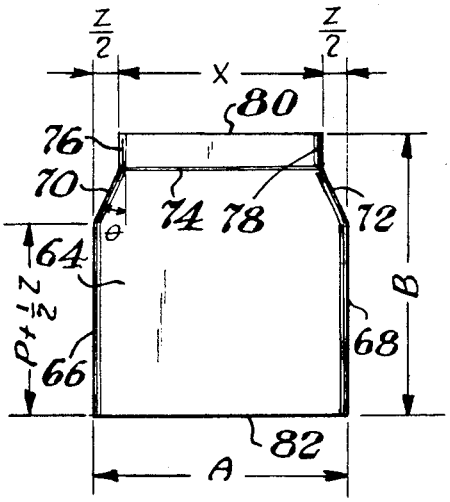
FIG. 9 is the liner of the present invention in its empty state.

Referring more now particularly to FIGS. 9 and 10, an unfilled preferable form of a box liner 64 made according to the principles of this invention has side seals 66 and 68 which are essentially vertical from bottom 82 and then angled inwardly at about the level where the top of the product will be located in a bag when filled, to form side seal portions 70 and 72 which portions are angularly disposed until they generally reach reclosable fastener 74. Thereafter the side seals extend generally vertically upwardly as side seal portions 76 and 78 until the top 80 of the bag 64 is reached. The side seals 66 and 68 may be non-gusseted. The bottom 82 of the bag has a dimension A, which is equivalent to the dimension A of the liner 46 of FIG. 6, but it has its top width and that of the reclosable fastener 74 essentially equivalent to the width X of the box of FIG. 5 as indicated on FIG. 9. Dimension X is therefore A minus Z over 2 ($\frac{1}{2}Z$) minus Z over 2 ($\frac{1}{2}Z$), which is the actual minimal horizontal width of the cutaway section 70/76 and 72/78 from the regular side seal dimensions defined by the side seals 66 and 68. Reference character P represents the height of the product in the liner and reference character 8 represents the angle seal portion 70 makes downwardly from the vertical. When the liner 64 is inserted into the box 44, it can be seen that the width of the entire bag, including the reclosable fastener 74 and bag top 80 is essentially the same as the width X of the box so as to provide the hereinbefore stated advantages of the present invention. The bag liner top and reclosable fastener can be readily opened and reclosed whether it remains below the top of the box where it can be reached as well as if lifted above the top of the box, and the top and reclosable fastener section of the liner does not have to be crimped or bunched to get that section of the bag liner into the box, as can be seen in FIG. 10.

As a specific example, taking a cereal box designed to hold about 15 ounces of a flake/raisin cereal mix and having a width dimension X of $6\frac{3}{8}$ inches, a height dimension Y of $9\frac{1}{2}$ inches, a depth Z of $2\frac{1}{4}$ inches, and where the filled product height P is about 7 inches, the seal width T is about $\frac{1}{2}$ inch, the lip or top section height is about $\frac{3}{4}$ of an inch, it can be determined that the liner width, the liner depth and the zipper width, empty, of the liner will be as follows using $\theta$ as 17°, calculated from tangent $\theta = \frac{1}{2}Z/[B-\frac{3}{4}-(P+\frac{1}{2}Z)]$ with $P+\frac{1}{2}Z=8\frac{1}{8}$ inches.

Liner Width $$A = 2(\text{seal width}) + \tfrac{1}{2}Z + X + \tfrac{1}{2}Z$$
$$A = 2(\tfrac{1}{2}'') + \tfrac{1}{2}(2\tfrac{1}{4}'') + 6\tfrac{1}{4}'' + \tfrac{1}{2}(2\tfrac{1}{4}'')$$
$$A = 1'' + 2\tfrac{1}{4}'' + 6\tfrac{3}{8}''$$
$$A = 9\tfrac{5}{8}''$$

Linear Depth $$B = \tfrac{1}{2}Z + P + \sqrt{(Y - P + 1)^2 + (\tfrac{1}{2}Z)^2} + \text{Lip Height}$$

$$B = \tfrac{1}{2}(2\tfrac{1}{4}) + 7 + \sqrt{(9\tfrac{1}{2} - 7 + 1)^2 + \left(\frac{2\frac{1}{4}}{2}\right)^2} + \tfrac{3}{4}''$$

$$B = 1\tfrac{1}{8}'' + 7 + 3.67 + \tfrac{3}{4}''$$
$$B = 12.55''$$

Zipper Width $= 6\frac{3}{8}''$

With such a configuration as described generally above, and as illustrated by the specific example employing the process of the present invention, it can be seen that a reclosable liner for a box can be achieved so that an advantageous, easy to use box liner can be produced. However, while certain representative embodiments and details have been shown for the purpose of illustrating the invention, it will be apparent to those skilled in the art that various changes in applications and configurations can be made therein without departing from the spirit and scope of the invention; for example, various resins can be used in forming the liner of the invention. The liner may be multi-layered or mono-layered; reclosable fasteners can be of various configurations; the liner can be sold as a package itself without being in a box; the box can be of different proportions; the reclosable fasteners can be formed with or separate from the liner, and the like.

Accordingly, what is claimed as new is:

1. A liner including a reclosable fastener permitting entry therein and exit therefrom of products, said liner located in a generally rectangularly shaped box, said liner having a base width wider than the top width thereof, said top width being generally about the same as the width of the box in which it is located, said liner having side seals the side seals of the liner being continuous from the top to the bottom thereof, said seals having a cropped sealed section adjacent the ends of the reclosable fastener so as to form a width transition zone between the side seals from the tops and the bottoms thereof.

2. The liner of claim 1, wherein the cropped section of the side seal is chamfered, the angle of the chamfer of the sides of the liner being determined by the chamfered sides which extend from about the product height adjacent each side seal to the reclosable fastener.

3. The liner of claim 2, wherein the side edges above the reclosable fastener are in the same angular direction as the side edges below the chamfered section of the transition zone.

4. The liner of claim 1 wherein the side seals are non-gusseted. pg.15

5. The process of forming a liner with a reclosable fastener, side walls and side seals for a box, which liner when empty has a width wider than the box in which said liner is to be placed, but said liner when filled with product has a width substantially the same as that of the box in which said liner is placed, said process involving the steps of determining a product level within the liner when filled and chamfering the side walls along said side seals from about said product level to at least said reclosable fastener, said chamfering being from a width generally about the same as the bottom of the bag at about the product level to generally about the width of the box at the reclosable fastener.

* * * * *